US006141429A

United States Patent [19]

Heinouchi

[11] Patent Number: 6,141,429

[45] Date of Patent: Oct. 31, 2000

[54] SPEAKER

[75] Inventor: Yoshiaki Heinouchi, Jouyou, Japan

[73] Assignee: Murata Manufacturing Co., Ltd., Kyoto, Japan

[21] Appl. No.: 09/322,325

[22] Filed: May 28, 1999

[30] Foreign Application Priority Data

Jun. 2, 1998 [JP] Japan ..... 10-153333
May 13, 1999 [JP] Japan ..... 11-132701

[51] Int. Cl.[7] ..... H04R 25/00

[52] U.S. Cl. ..... 381/398; 381/190; 181/171

[58] Field of Search ..... 381/398, 190, 381/340, 341, 342, 343, 430, FOR 153; 181/171, 172, 159

[56] References Cited

U.S. PATENT DOCUMENTS 5,802,196 9/1998 Nakamura ..... 381/190
5,896,460 4/1999 Nakamura et al. ..... 381/190

FOREIGN PATENT DOCUMENTS 2 250 697 5/1973 Germany .
2905566 8/1980 Germany .
26 48 428 5/1988 Germany .
9-3222835 12/1997 Japan .

*Primary Examiner*—Curtis A. Kuntz
*Assistant Examiner*—P. Dabney
*Attorney, Agent, or Firm*—Keating & Bennett, LLP

[57] ABSTRACT

A speaker has a structure such that vibrations of a ring-shaped vibrator are reliably damped by ensuring contact between the rim of the vibrator and a bottom of a groove provided in a supporting member, even in a hot and moist environment. A ring-shaped rim of a vibrator is secured in the bottom of the groove formed in the supporting member, via a doughnut-shaped double-sided tape. The groove is filled with urethane resin which is hardened. Even when the urethane resin is expanded in a hot and moist environment, the vibrator does not rise up from the bottom of the groove. Consequently, the vibrations of the vibrator are reliably damped, the desired excellent impedance characteristics are obtained, and as a result, evenness of sound waves is ensured.

20 Claims, 5 Drawing Sheets

SPEAKER

BACKGROUND OF THE INVENTION

1. Field of the Invention

The present invention relates to a speaker, and more particularly, to a speaker including a substantially hemispherical vibrator.

2. Description of the Related Art

The structure of a conventional speaker will be explained with reference to FIGS. 4, 5 and 6 which speaker is described Japanese Unexamined Patent Publication No. 9-322283.

As seen in FIGS. 4–6, a speaker 1 includes a hemispherical vibrator 2. The vibrator 2 has a hemispherical vibrating body 4 made of a piezoelectric material such as ceramic. To vibrate the vibrating body 4, electrodes 6*a* and 6*b* are provided respectively on a curved inner surface and a curved outer surface of the vibrating body 4 so as to provide a driving member for driving and vibrating the vibrating body 4. The vibrating body 4 is polarized along its width.

Furthermore, the vibrator 2 is connected to a horn 8 made of synthetic resin. The horn 8 includes an upper base 10, a supporting member 16, a first cylinder 30, a second cylinder 32, a third cylinder 34, a fourth cylinder 38, a fifth cylinder 42 and a lower base 46.

The upper base 10 has a projection 12. A flange 14 is provided around the projection 12, and a hole 20 is provided inside the projection 12. Furthermore, a ring-shaped convex portion 22, which is triangular in cross-section, is arranged so as to surround the opening of the hole 20, a ring-shaped flat portion 24 is arranged so as to surround the convex portion 22, a ring-shaped convex portion 26 is arranged so as to surround the flat portion 24, and finally, a ring-shaped flat portion 28 is arranged on the outermost side so as to surround the convex portion 26. Furthermore, a ring-shaped groove 16*a* is provided in one main surface of the supporting member 16.

The ring-shaped rim 2*a* of the vibrator 2 clips into the groove 16*a* of the supporting member 16, the groove 16*a* is filled with urethane resin (not shown in the Figures) and when the urethane resin hardens, the vibrator 2 is thereby secured to the supporting member 16.

The vibrator 2 is attached around the outer rim of the projection 12 of the upper base 10, with the supporting member 16 disposed in between the vibrator and the projection 12. Thus, the vibrator 2 is arranged so as to cover the projection 12, and a cavity 18 is defined between the vibrator 2 and the projection 12 to allow the vibrator 2 to vibrate. The electrodes 6*a* and 6*b* of the vibrator 2 are connected via a conductive ribbon (not shown in the Figures) to an input terminal (not shown in the Figures), which is provided on the outer side of the vibrator 2.

Alternatively, the supporting member 16 may be formed as a single integral body with the upper base 10.

Furthermore, one end of the first cylinder 30 is inserted through the hole 20 in the upper base 10 to the head of the projection 12. The inner rim surface of one end of the second cylinder 32, which has a larger diameter than the first cylinder 30, attaches to the outer rim of the other end of the first cylinder 30, and in addition, the inner rim surface of one end of the third cylinder 34, which has a larger diameter than the second cylinder 32, is attached to the outer rim of the other end of the second cylinder 32. Multiple V-shaped notch portions 36 are provided at equal intervals roughly all the way away around the other end of the third cylinder 34.

The notch portions 36 gradually widen as they are located closer to the end surface of the other end of the third cylinder 34.

Furthermore, the end surface of one end of the fourth cylinder 38, which has a larger diameter than the third cylinder 34, is attached to the flat portion 24 of the upper base 10. Multiple V-shaped notch portions 40 are provided at equal intervals roughly all the way around the other end of the fourth cylinder 38. The notch portions 40 gradually widen as they are located closer to the end surface of the fourth cylinder 38.

Furthermore, the surface of one end of the fifth cylinder 42, which has a larger diameter than the fourth cylinder 38, is attached to the flat portion 28 of the upper base 10. Multiple V-shaped notch portions 44 are provided at equal intervals roughly all the way around the other end of the fifth cylinder 42. The notch portions 44 gradually widen as they are located closer to the end surface of the fifth cylinder 42.

Furthermore, the lower base 46 has a cone-like convex portion 48, a ring-shaped flat portion 50, a ring-shaped convex portion 52 and a ring-shaped flat portion 54. The end surfaces of the other ends of the third cylinder 34 and the fourth cylinder 38 are affixed respectively to the flat portions 50 and 54 of the lower base 46.

Furthermore, a sound path is provided inside of the vibrator 2 and the horn 8. The cross-sectional area of the sound path widens in steps from the inner surface of the vibrator 2, via the first cylinder 30, the second cylinder 32 and the third cylinder 34, and as indicated by the arrow P in FIG. 5, loops from the notch portions 36 of the third cylinder 34 via the fourth cylinder 38, reaching the fifth cylinder 42 via the notch portions 40, and arriving at the notch portions 44 of the fifth cylinder 42.

In the speaker 1 having such a construction, when an electrical signal is input to the input terminal, the vibrator 2 vibrates, whereby sound waves are emitted from its outer surface. In addition, sound waves are emitted from the inner surface of the vibrator 2 via the cavity 18 and the sound path. Since the vibrator 2 is hemispherical, nondirectional sound waves are transmitted in a direction parallel to the surface of the device and the floor surface or surface supporting the speaker 1.

Since the vibrator 2 is hemispherical, the sound waves emitted from the curved outer surface of the vibrator 2 are emitted in all directions relative to the surface supporting the speaker or the floor surface, and are consequently nondirectional. Furthermore, the sound waves which are emitted from the curved inner surface of the vibrator 2, via the cavity 18 and the sound path, are transmitted in all directions relative to the surface of the speaker and the floor surface, and are consequently nondirectional. In this way, the speaker 1 is nondirectional relative to the surface supporting the speaker, i.e. the floor surface.

Furthermore, in the speaker 1, the ring-shaped rim 2*a* of the vibrator 2 is secured by contacting the bottom 16*a*1 of the groove 16*a* of the supporting member 16, so that the vibrations of the vibrator 2 are damped, thereby obtaining desired impedance characteristics and ensuring even a sufficient sound pressure.

However, when the speaker 1 experiences extremely high temperature and moisture in environmental tests and the like, there are occasions in which the urethane resin, which fills the groove 16*a* of the supporting member 16, expands and the urethane resin rises up together with the vibrator 2, causing a cavity to be defined between the vibrator 2 and the bottom 16*a*1 of the groove 16*a*. When such a cavity occurs, there is a danger that the vibrations of the vibrator 2 cannot be adequately damped, the desired impedance characteristics cannot be obtained, and as a result, evenness of the sound waves is hindered.

SUMMARY OF THE INVENTION

In order to overcome the problems described above, preferred embodiments of the present invention provide a speaker in which the vibrations of the vibrator can be reliably damped, by maintaining contact between the ring-shaped peripheral portion of the vibrator and the bottom of the groove of the supporting member, even in a hot and moist environment.

In order to achieve the above-mentioned advantages, a speaker according to preferred embodiments of the present invention includes a substantially hemispherical vibrator having a ring-shaped rim, a supporting member having a ring-shaped groove, the vibrator being secured to the supporting member by the rim of the vibrator being clipped into the groove, a driver arranged to drive and vibrate the vibrator, a horn arranged to extend from a curved inner surface of the vibrator to an outer portion of the vibrator and having a sound path at a middle portion thereof, an attaching member arranged to fix the rim of the vibrator to a bottom of the groove of the supporting member, and the groove of the supporting member being filled with resin so that the vibrator is secured to the supporting member via the resin.

In another preferred embodiment of the present invention, a speaker includes a substantially hemispherical vibrator having a ring-shaped rim, a supporting member having a ring-shaped groove, the vibrator being secured to the supporting member by the rim of the vibrator being clipped into the groove, a driver arranged to vibrate the vibrator, a horn arranged to extend from a curved inner surface of the vibrator to an outer portion of the vibrator and having a sound path a middle portion thereof, plate spring members provided in the groove of the supporting member, the rim of the vibrator being clipped into the groove of the supporting member via the plate spring members, and the groove of the supporting member being filled with resin so that the vibrator is secured to the supporting member via the resin.

According to the speaker of preferred embodiments of the present invention, the rim of the vibrator is fixed into the groove of the supporting member via an attaching or fixing member. Also, when the groove is filled with resin and the resin hardens, the vibrator is secured in place. Therefore, even when the resin, which is filled into the groove of the supporting member, expands in a hot and moist environment, the vibrator does not rise up from the bottom of the groove of the supporting member.

Furthermore, according to preferred embodiments of the speaker of the present invention, resin is filled into the groove of the supporting member, so as to fit within plate spring members, and the resin is hardened so that any expansion of the resin itself is prevented. Consequently, the vibrator does not rise up from the bottom of the groove of the supporting member.

Therefore, since the vibrator does not rise up from the bottom of the groove of the supporting member, the vibrations of the vibrator are reliably damped, desired excellent impedance characteristics are obtained, and as a result, evenness of the sound waves is ensured.

For the purpose of illustrating the invention, there is shown in the drawings several forms which are presently preferred, it being understood, however, that the invention is not limited to the precise arrangements and instrumentalities shown.

DETAILED DESCRIPTION OF PREFERRED EMBODIMENTS

Figure 1:
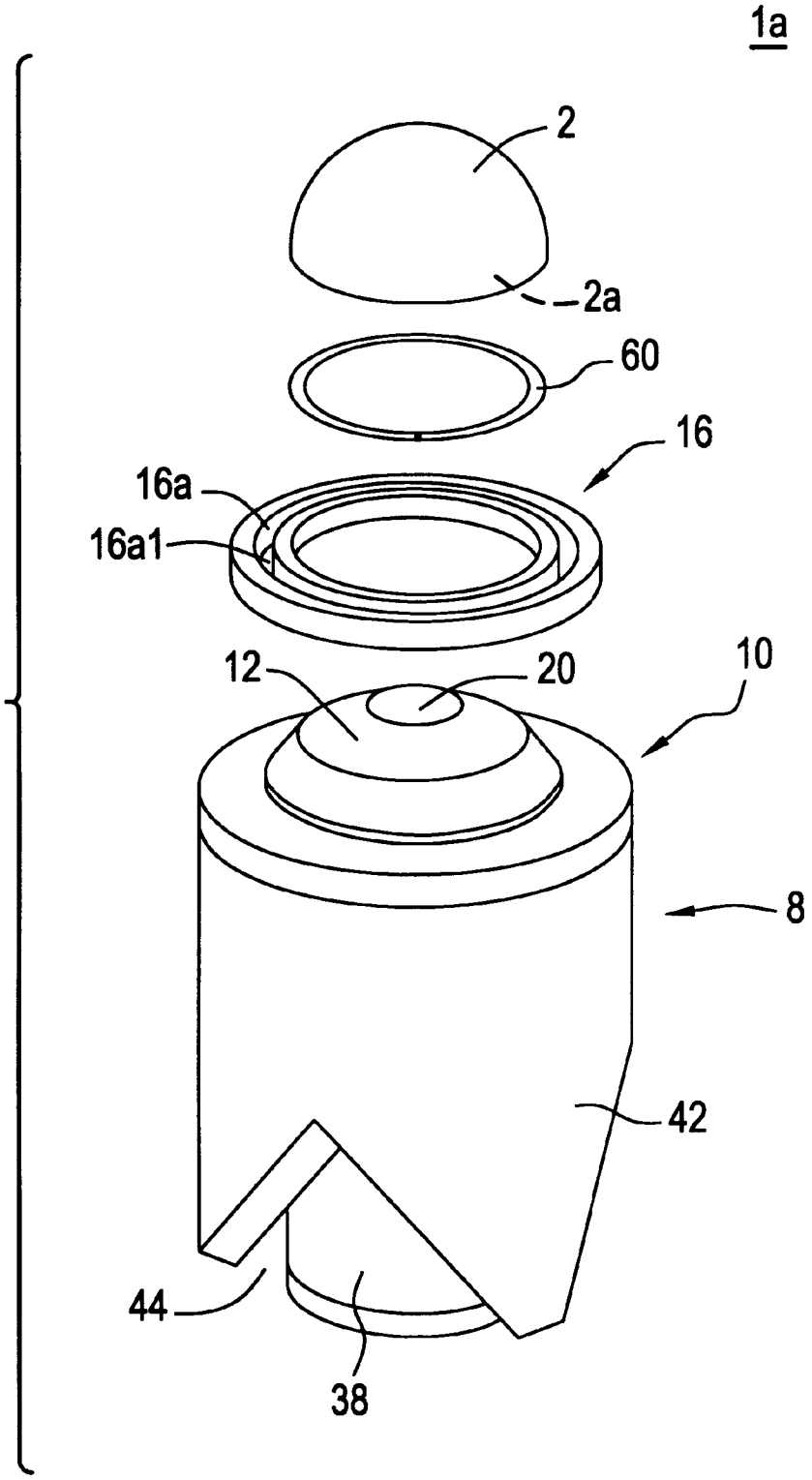
FIG. 1 is an exploded perspective view of primary elements of a speaker according to a first preferred embodiment of the present invention.
Figure 4:
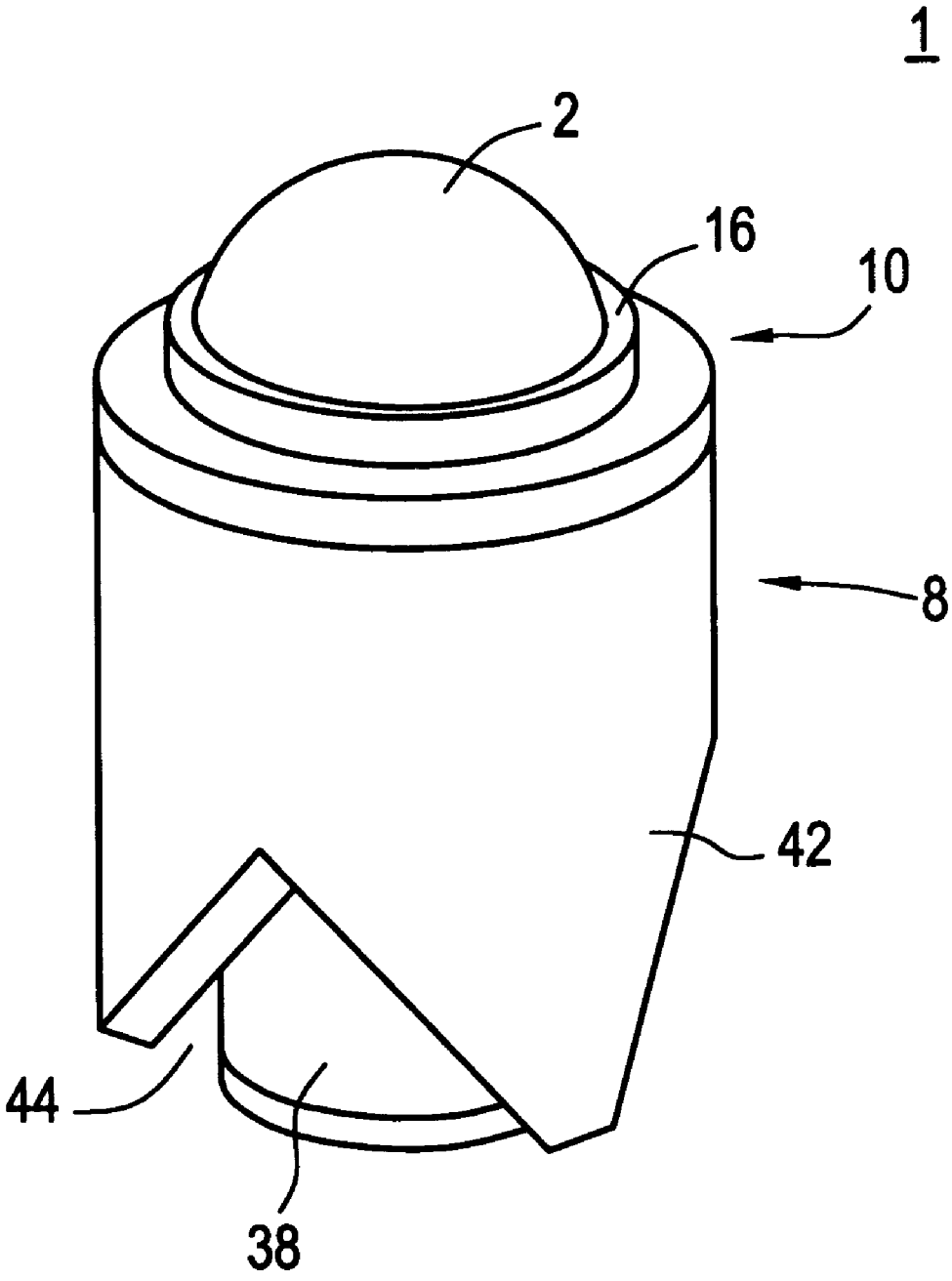
FIG. 4 is a perspective view showing a conventional speaker.
Figure 5:
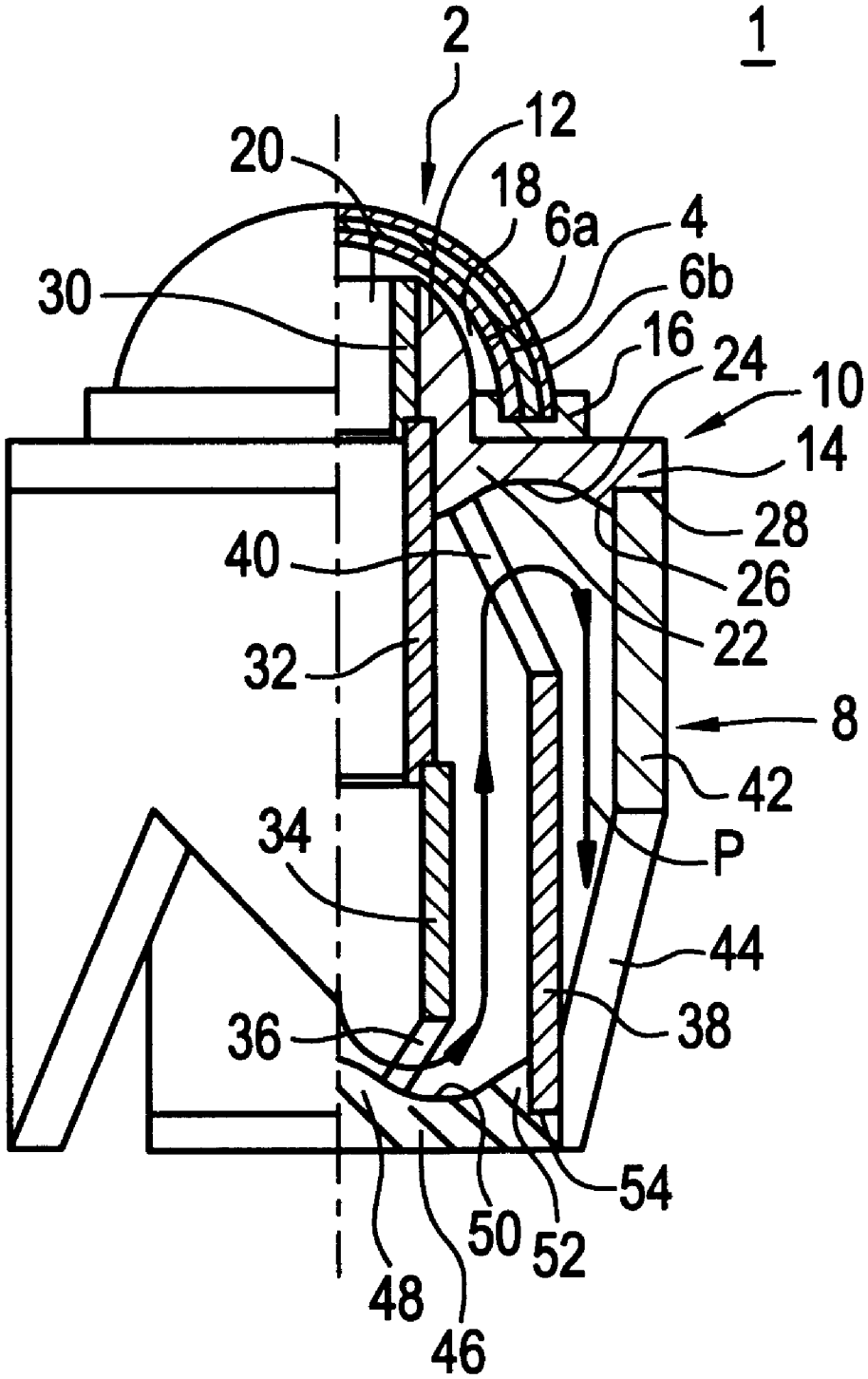
FIG. 5 is a partial cross-sectional view of the speaker of FIG. 4.
Figure 6:
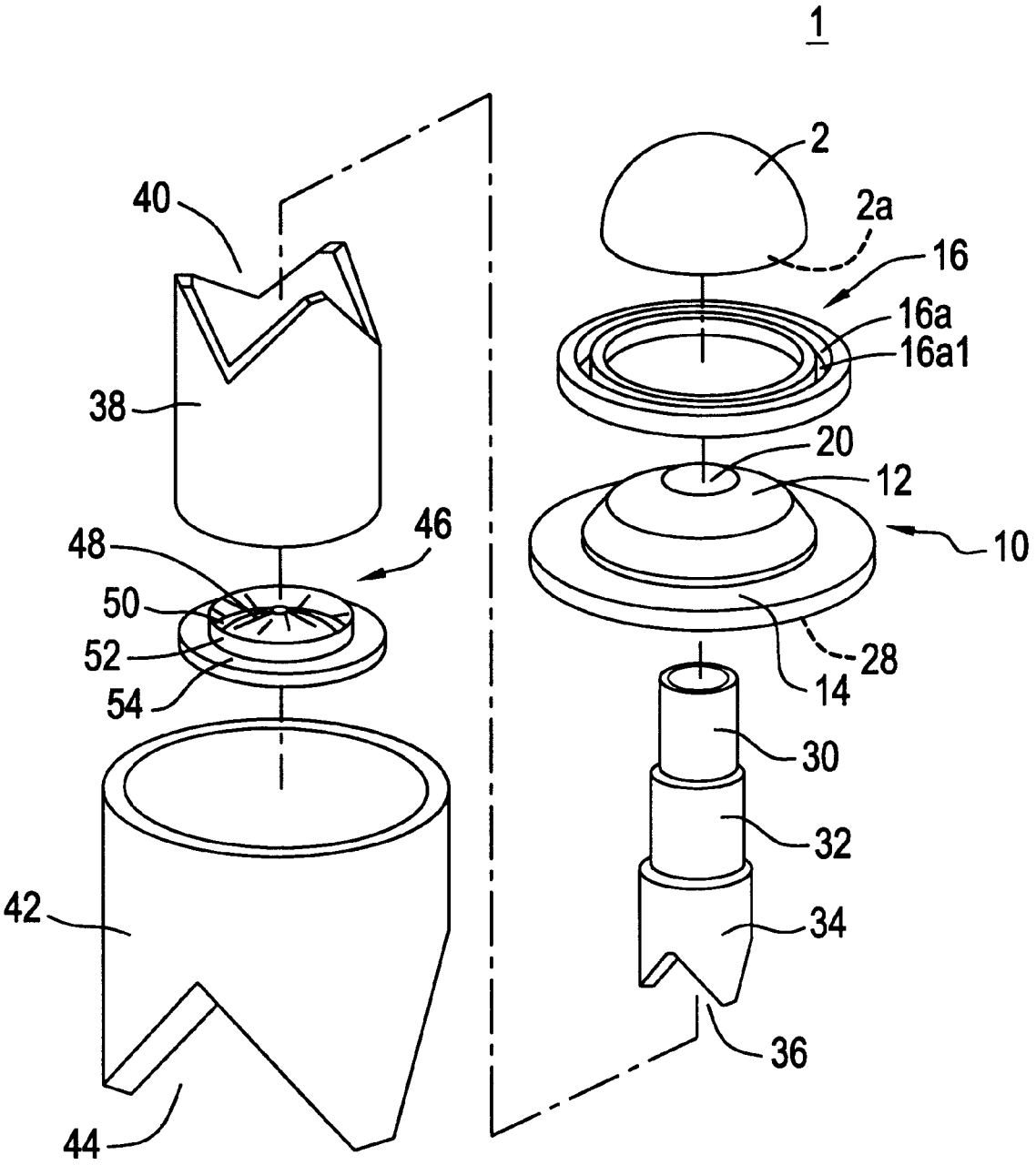
FIG. 6 is a diagrammatic exploded perspective view of the speaker of FIG. 4.

A construction of a speaker according to a first preferred embodiment of the present invention will be explained using FIG. 1. In FIG. 1, only the main primary elements, and the same reference characters are used to indicate the same or corresponding elements as those shown in FIG. 4 to FIG. 6. Explanation of the same elements is omitted. Furthermore, since the operation whereby sound waves are emitted from the outer surface of the vibrator and via a sound path inside the horn is the same as the conventional example, the explanation of such an operation will be omitted.

In FIG. 1, a speaker 1*a* preferably includes a substantially hemispherical vibrator 2, formed from a piezoelectric material such as ceramic, and a horn 8, including an upper base 10, a supporting member 16, a first cylinder 30, a second cylinder 32, a third cylinder 34, a fourth cylinder 38, a fifth cylinder 42 and a lower base 46. The supporting member 16 preferably has a ring-shaped groove 16 in one main surface, and a double-sided tape 60, punch-cut to have a substantially doughnut-shaped configuration so as to substantially correspond to the shape of the bottom 16*a*1, is attached to the bottom 16*a* of the groove 16*a*. The double-sided tape 60 therefore defines an attaching or connecting member. However, as will be described below, many other types attaching members may be used.

The ring-shaped rim 2*a* of the vibrator 2 is clipped into the groove 16*a* in the supporting member 16, and is secured to the bottom 16*a*1 of the groove 16*a* via the double-sided tape 60. Moreover, the groove 16*a* is preferably filled with urethane resin (not shown in FIG. 1), and when the urethane resin hardens, the vibrator 2 is secured to the supporting member 16.

The supporting member 16 does not have to be formed as an independent member, and may be formed together with the upper base 10 as a single integral unit.

According to the speaker 1*a* of this preferred embodiment, even when the hardened urethane resin expands and rises up in a hot and moist environment, the 20 vibrator 2 remains secured to the bottom 16*a*1 of the groove 16*a* via the double-sided tape, and therefore, no cavity or space is created between the bottom 16*a*1 of the groove 16*a* and the vibrator 2. Consequently, the vibrations of the vibrator 2 are reliably damped, the desired excellent impedance characteristics are obtained, and as a result, even sound waves are ensured.

Figure 2:
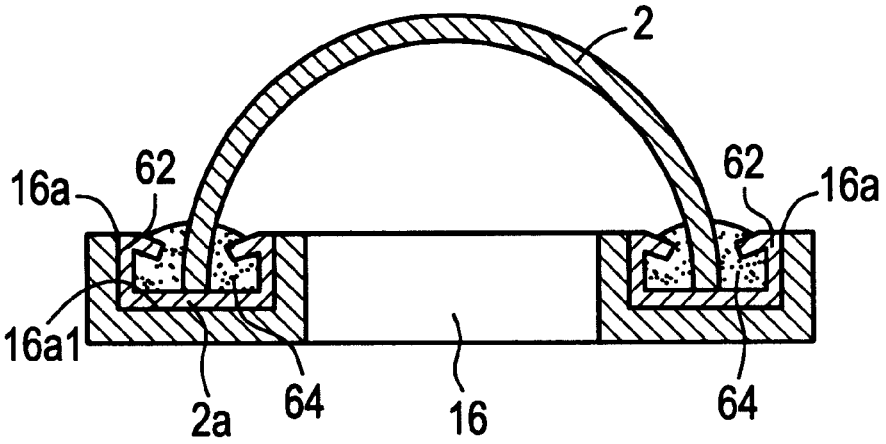
FIG. 2 is a cross-sectional view of primary element of a speaker according to a second preferred embodiment of the present invention.

Next, the construction of a speaker according to a second preferred embodiment of the present invention will be explained with reference to FIG. 2. In FIG. 2, only the vibrator, the supporting member and members relating to their connection are depicted. Furthermore, in FIG. 2, the same and elements corresponding to those of FIG. 1 are represented by the same reference numerals, and explanation of such similar elements is omitted.

Figure 3:
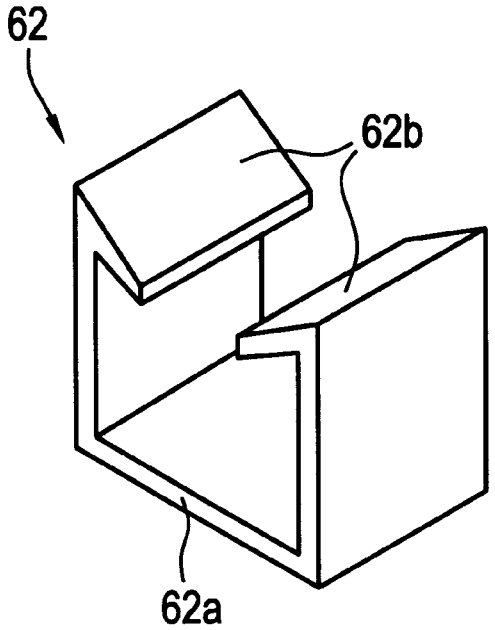
FIG. 3 is a perspective view of a plate spring member provided in the speaker of FIG. 2.

In FIG. 2, a substantially hemispherical vibrator 2 defines a speaker, and a supporting member 16 has a ring-shaped groove 16*a*. Multiple plate spring members 62 are spaced along the bottom 16*a*1 of the groove 16*a* of the supporting member 16. The plate spring members 62 are preferably made from metal, and, as shown in FIG. 3, the plate spring members 62 preferably include an approximately U-shaped main body 62*a* and claws 62*b*, provided on both sides of the main body 62*a*. The height of the plate spring members 62 substantially corresponds to the depth of the groove 16*a* of the supporting member 16.

The rim 2*a* of the vibrator 2 clips into the groove 16*a* of the supporting member 16 via the plate spring members 62. Moreover, the groove 16*a* is filled with urethane resin 64, and when the urethane resin 64 hardens, the vibrator 2 is secured to the supporting member 16. As shown in FIG. 2, the urethane resin 64 fits inside of the plate spring members 62 and is pressed down by the claws 62*b* of the plate spring members 62.

In the speaker 1*b* according to this preferred embodiment, even when the hardened urethane resin attempts to expand in a hot or moist environment, the expansion of the urethane resin 64 is prevented by the plate spring members 62. As a result, the expansion of the urethane resin 64 does not cause a space or cavity to be created between the bottom 16*a*1 of the groove 16*a* and the vibrator 2. Consequently, the vibrations of the vibrator 2 are reliably damped, the desired excellent impedance characteristics are obtained, thereby ensuring evenness of the sound waves.

In the above-mentioned first preferred embodiment, doubled-sided tape is used as the attaching or connecting member to secure the rim of the vibrator in the groove of the supporting member, but an adhesive such as an epoxy-type adhesive and silicone adhesive may be used instead.

In the second preferred embodiment, plate spring members 62 are used as the attaching or connecting member to secure the rim of the vibrator in the groove of the supporting member.

Other constructions of the attaching or connecting member may also be used.

Furthermore, the explanations of the first and second preferred embodiments described cases in which the supporting member is ring-shaped and is mounted on the upper base. However, as long as the supporting member has a groove corresponding to the ring-shaped rim of the vibrator, it is not limited to the shape described above, and may for instance be formed as a single integral unit with the upper base.

Furthermore, the first and second preferred embodiments describe cases in which the groove of the supporting member is filled with urethane resin, but a hardening resin other than urethane resin may also be used.

According to the speaker of preferred embodiments of the present invention, the rim of a vibrator is fixed into a groove of a supporting member by an attaching or connecting member, and the vibrator is secured in place when the groove is filled with resin and the resin hardens. Therefore, even when the resin in the groove of the supporting member expands in a hot and moist environment, the vibrator does not rise up from the bottom of the groove of the supporting member.

Furthermore, according to preferred embodiments of the speaker of the present invention, the resin is filled into the groove of the supporting member so as to fit and harden within plate spring members. Therefore, the expansion of the resin itself is prevented. Consequently, the vibrator does not rise up from the bottom of the groove of the supporting member.

Thus, since the vibrator does not rise up from the bottom of the groove of the supporting member, the vibrations of the vibrator are reliably damped, the desired excellent impedance characteristics are obtained, ensuring even sound waves.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A speaker, comprising:

a substantially hemispherical vibrator having a ring-shaped rim;

a supporting member having a ring-shaped groove, the vibrator being secured to the supporting member by the rim of the vibrator being clipped into the groove;

a driver arranged to drive and vibrate the vibrator;

a horn arranged to extend from a curved inner surface of the vibrator to an outer portion of the vibrator and having a sound path at a middle portion thereof;

an attaching member arranged to fix the rim of the vibrator to a bottom of the groove of the supporting member; and resin being provided so as to fill the groove of the supporting member so that the vibrator is secured to the supporting member at least via the resin.

2. The speaker according to claim 1, wherein the attaching member comprises a doubled-sided tape.

3. The speaker according to claim 2, wherein the double-sided tape has a substantially doughnut-shaped configuration so as to substantially correspond to the shape of the bottom of the groove.

4. The speaker according to claim 2, wherein the double-sided tape is arranged to secure the rim of the vibrator in the groove of the supporting member.

5. The speaker according to claim 1, wherein the attaching member comprises an epoxy adhesive.

6. The speaker according to claim 5, wherein the epoxy adhesive is arranged to secure the rim of the vibrator in the groove of the supporting member.

7. The speaker according to claim 1, wherein the attaching member comprises a plurality of plate spring members being provided in the groove of the supporting member.

8. The speaker according to claim 7, wherein the plurality of plate spring members are arranged such that the rim of the vibrator is clipped into the groove of the supporting member via the plurality of plate spring members.

9. The speaker according to claim 1, wherein the substantially hemispherical vibrator is made of a piezoelectric material.

10. The speaker according to claim 1, wherein the horn includes an upper base, the supporting member, a first cylinder, a second cylinder, a third cylinder, a fourth cylinder, a fifth cylinder and a lower base.

11. The speaker according to claim 1, wherein the resin is arranged to prevent a space from being formed between the bottom of the groove and the vibrator despite an increase in temperature and moisture in an area where the resin is located.

12. The speaker according to claim 1, wherein the attaching member comprises a plurality of plate spring members being provided in the groove of the supporting member and the plate spring members are made from metal.

13. The speaker according to claim 12, wherein the plate spring members include an approximately U-shaped main body and claws provided on both sides of the main body.

14. The speaker according to claim 13, wherein the height of the plate spring members substantially corresponds to the depth of the groove of the supporting member.

15. The speaker according to claim 14, wherein the resin is pressed down by the claws of the plate spring members.

16. The speaker according to claim 1, wherein the horn includes an upper base, and the supporting member defines a single integral unit with the upper base.

17. The speaker according to claim 1, wherein the resin is a urethane resin.

18. A speaker, comprising:

a substantially hemispherical vibrator having a ring-shaped rim;

a supporting member having a ring-shaped groove, the vibrator being secured to the supporting member by the rim of the vibrator being clipped into the groove;

a driver arranged to drive and vibrate the vibrator;

a horn arranged to extend from a curved inner surface of the vibrator to an outer portion of the vibrator and having a sound path at a middle portion thereof;

plate spring members being provided in the groove of the supporting member, the rim of the vibrator being clipped into the groove of the supporting member via the plate spring members; and resin being provided so as to fill the groove of the supporting member so that the vibrator is secured to the supporting member at least via the resin.

19. The speaker according to claim 18, wherein the plurality of plate spring members are arranged such that the rim of the vibrator is clipped into the groove of the supporting member via the plurality of plate spring members.

20. The speaker according to claim 18, wherein the height of the plate spring members substantially corresponds to the depth of the groove of the supporting member.

* * * * *